US007028762B2

(12) United States Patent
Iritani et al.

(10) Patent No.: US 7,028,762 B2
(45) Date of Patent: Apr. 18, 2006

(54) CONDENSER FOR REFRIGERATING MACHINE

(75) Inventors: Yoichiro Iritani, Takasago (JP); Akihiro Kawada, Takasago (JP); Yoshinori Shirakata, Nishi-kasugai-gun (JP); Wataru Seki, Nishi-kasugai-gun (JP); Koji Hirokawa, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/078,407

(22) Filed: Mar. 14, 2005

(65) Prior Publication Data

US 2005/0150638 A1 Jul. 14, 2005

Related U.S. Application Data

(62) Division of application No. 09/983,159, filed on Oct. 23, 2001, now abandoned.

(30) Foreign Application Priority Data

Oct. 24, 2000 (JP) ..... 2000-323465

(51) Int. Cl.
*F28B 1/00* (2006.01)

(52) U.S. Cl. ..... 165/110; 165/157; 62/506

(58) Field of Classification Search ..... 165/110, 165/113, 157; 62/506, 509
See application file for complete search history.

(56) References Cited

U.S. PATENT DOCUMENTS

| | | | |
|---|---|---|---|
| 956,210 | A | 4/1910 | Snow |
| 1,145,334 | A | 7/1915 | Pratt |
| 1,562,682 | A | 11/1925 | Braun |
| 2,285,651 | A | 6/1942 | Fischer |
| 2,324,627 | A | 7/1943 | Jones |
| 2,392,638 | A | 1/1946 | Bowman et al. |
| 2,830,797 | A | 4/1958 | Garland |
| 3,267,693 | A | 8/1966 | Richardson et al. |
| 3,587,732 | A | 6/1971 | Burne |
| 4,249,596 | A | 2/1981 | Tutak et al. |
| 4,972,903 | A | 11/1990 | Kwok |
| 6,481,242 | B1 | 11/2002 | Shirakata et al. |
| 6,497,115 | B1 | 12/2002 | Shirakata et al. |
| 6,655,173 | B1 | 12/2003 | Iritani et al. |
| 2002/0157417 | A1 | 10/2002 | Iritani et al. |

FOREIGN PATENT DOCUMENTS

| | | |
|---|---|---|
| DE | 28 26 707 | 12/1979 |

(Continued)

*Primary Examiner*—Terrell McKinnon
(74) *Attorney, Agent, or Firm*—Oblon, Spivak, McClelland, Maier & Neustadt, P.C.

(57) ABSTRACT

This invention provides a condenser for a refrigerating machine which can improve the condensation characteristics by eliminating the accumulation of the condensed refrigerant in the condenser vessel. The condenser comprising the vessel 14 and a group of heat exchanger tubes 15 disposed in the vessel is used for condensing and liquefying the gaseous refrigerant by heat exchange between the gaseous refrigerant and cooling water circulating in the heat exchanger tubes. The condenser is constituted such that accumulated liquefied refrigerant is removed by forming one or a plurality of spaces in the area wherein the heat exchanger tubes are disposed.

1 Claim, 4 Drawing Sheets

FOREIGN PATENT DOCUMENTS

| | | |
|---|---|---|
| DE | 3219424 | 2/1983 |
| JP | 53-88860 | 7/1978 |
| JP | 55-049695 | 10/1980 |
| JP | 56-140073 | 10/1981 |
| JP | 59-103081 | 7/1984 |
| JP | 63-148007 | 9/1988 |
| JP | 5-71827 | 3/1993 |
| JP | 08-159611 | 6/1996 |
| JP | 8-338671 | 12/1996 |
| JP | 2000-18845 | 1/2000 |

CONDENSER FOR REFRIGERATING MACHINE

This application is a division of U.S. patent application Ser. No. 09/983,159 filed Oct. 23, 2001 now abandoned, the entire contents of which are incorporated herein by reference.

BACKGROUND OF THE INVENTION

1. Field of the Invention

The present invention relates to a condenser for a refrigerating machine, which is used for condensing and liquefying a gaseous refrigerant after heat exchange between the gaseous refrigerant and cooling water.

2. Description of the Related Art

In a large scale structure such as a building, for example, the inside space of the building is cooled by circulating cooled water in pipes installed in the building for heat exchange between the cooled water and the air in the building.

FIG. 7 shows an example of a condenser included in a refrigerating machine. As shown in FIG. 7, this condenser comprises a cylindrical vessel 1 in which a bundle of a plurality of heat exchanger tubes 2 is arranged in a staggered manner.

There are two groups of heat exchanger tubes 2, one of which comprises the forward side (first passing group or first group) tubes, communicated with a cooling water inlet 3, and the other of which comprises backward side (second passing group or second group) tubes, communicated with a cooling water outlet 4. The forward side heat exchanger tubes are arranged to be located lower in the vessel, and the backward side heat exchanger tubes are arranged to be located higher in the vessel. Cooling water supplied from the cooling water inlet 3 passes through the forward side heat exchanger tubes and reaches to a water chamber (not shown), and then the cooling water returns through the backward side heat exchanger tubes from the water chamber to be discharged from the cooling water outlet 4. In this circulation process, the gaseous refrigerant introduced into the vessel 1 by a compressor (not shown) is cooled, condensed and liquefied through the heat exchange with the cooling water. Note that the liquefied refrigerant is supplied to an evaporator (not shown).

However, a problem arises in that, since the heat exchanger tubes are arranged densely in the above-described condenser, the condensed liquid refrigerant moves towards the right and left sides of the vessel along the heat exchanger tubes by the supply pressure of the gaseous refrigerant introduced into the vessel and the condensed liquid often accumulates in both the right and left end portions of the foreward side heat exchanger tubes located lower in of the vessel. When the condensed liquid is accumulated around the second group of heat exchanger tubes, the thick condensed liquid layer accumulated around the heat exchanger tubes causes an increase in the heat resistance of the tubes and causes degradation of the condensation performance of the condenser.

SUMMARY OF THE INVENTION

The present invention has an object of suppressing accumulation or concentration of the condensed liquid around the heat exchanger tubes and to provide a condenser for the refrigerating machine having improved condensation performance.

The present invention provides a condenser for a refrigerating machine which comprises a vessel into which a gaseous refrigerant is introduced and a bundle of heat exchanger tubes disposed in said vessel for condensing and liquefying a gaseous refrigerant by heat exchange between said gaseous refrigerant and cooling water circulating in the heat exchanger tubes, wherein one or a plurality of vacant spaces are formed with a vertical orientation in the area in which the heat exchanger tubes are disposed, in order to prevent the liquefied refrigerant from accumulating around the second group of heat exchanger tubes and to accelerate the inflow of the gaseous refrigerant.

In the above condenser for a refrigerating machine, the vacant space is formed so as to pass through the cross-sectional area in which said heat exchanger tubes are disposed.

In the above condenser for a refrigerating machine, the vacant space is formed vertically when viewed in cross-section such that the space starts from the bottom and reaches an upper portion of the area in which the heat exchanger tubes are disposed.

The present invention provides another type of the condenser for a refrigerating machine which comprises a vessel into which a gaseous refrigerant is introduced and a group of heat exchanger tubes disposed in said vessel for condensing and liquefying a gaseous refrigerant by heat exchange between said gaseous refrigerant and cooling water circulating in said heat exchanger tubes, wherein a plurality of porous plates are arranged at the inner peripheral surface of said vessel for guiding said gaseous refrigerant flowing along the inner surface of said vessel towards said group of heat exchanger tube groups.

The present invention provides yet another type of condenser for a refrigerating machine which comprises a vessel into which a gaseous refrigerant is introduced and a group of heat exchanger tubes disposed in said vessel for condensing and liquefying a gaseous refrigerant by heat exchange between said gaseous refrigerant and cooling water circulating in said heat exchanger tubes, wherein said heat exchanger tubes are arranged at equal intervals, and said heat exchanger tubes located in the lower part are used for supplying said cooling water and said heat exchanger tubes located in the upper part are used for discharging said cooling water, and the number of heat exchanger tubes located in said upper part is less than the number of heat exchanger tubes located in said lower part of the vessel by making the area of said upper part smaller than that of said lower part.

The present invention provides yet another condenser for a refrigerating machine which comprises a vessel into which a gaseous refrigerant is introduced and a group of heat exchanger tubes disposed in said vessel for condensing and liquefying a gaseous refrigerant by heat exchange between said gaseous refrigerant and cooling water circulating in said heat exchanger tubes, wherein said heat exchanger tubes located in the lower part are used for supplying said cooling water and said heat exchanger tubes located in the upper part are used for discharging said cooling water, and the number of heat exchanger tubes located in said upper part is less than the number of heat exchanger tubes located in said lower part of the vessel by setting the interval between heat exchanger tubes in the upper part to be larger than the interval between heat exchanger tubes in the lower part.

DETAILED DESCRIPTION OF THE INVENTION

Hereinafter, embodiments of the condensers for the refrigerating machine of the present invention will be described.

Figure 1:
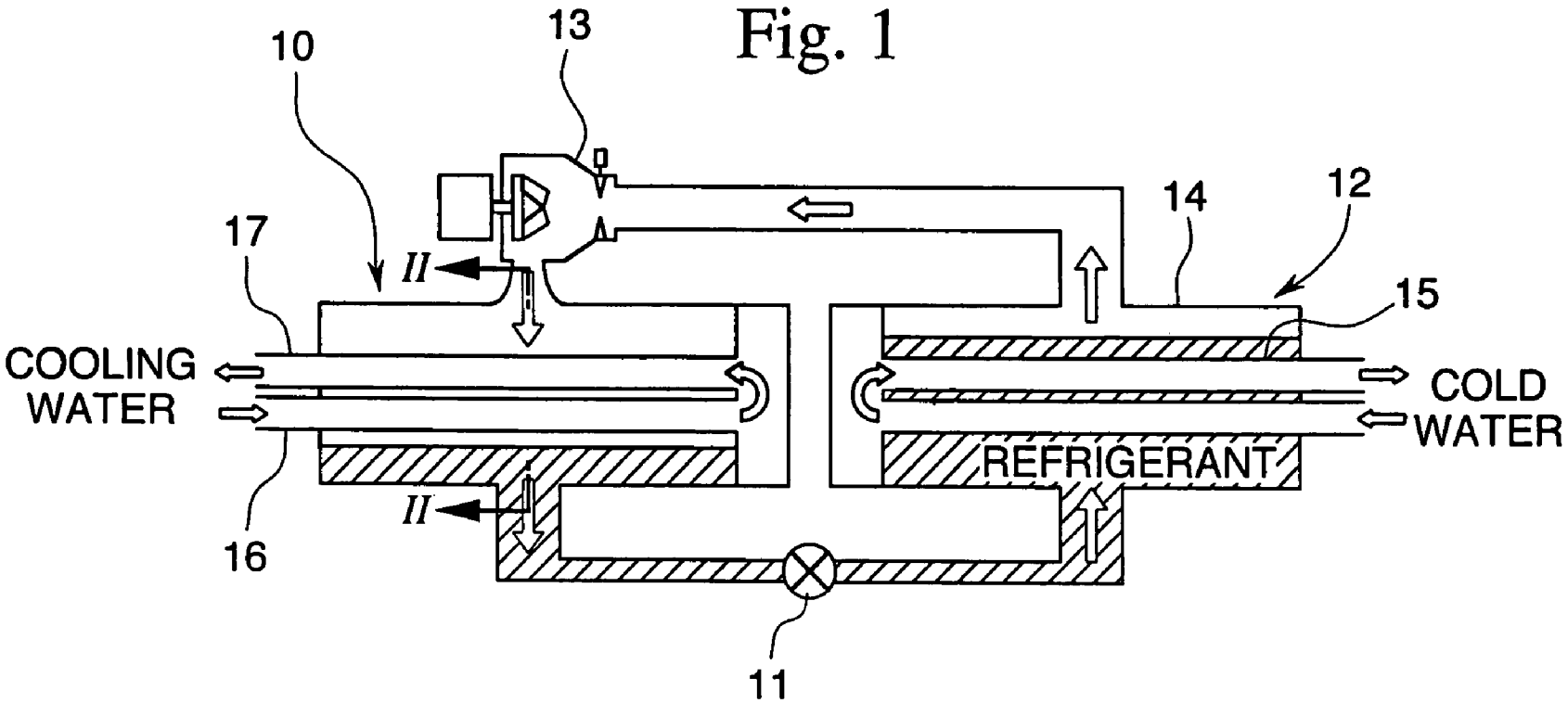
FIG. 1 is a cross-sectional diagram showing a schematic structure of a refrigerating machine to which the condenser according to the present invention is applied.

FIG. 1 shows a schematic structure of a refrigerating machine. This refrigerating machine comprises a condenser 10 for condensing and liquefying a refrigerant by heat exchange between the cooling water and gaseous refrigerant, an expansion valve 11 for pressure reduction of the condensed refrigerant, an evaporator 12 for cooling the cooling water by heat exchange between the condensed refrigerant and the cooling water, and a compressor 13 for supplying the refrigerant to the condenser 10 after evaporation and vaporization of the refrigerant. Note that the cooled water in the above-described evaporator is used for cooling of the building.

Figure 2:
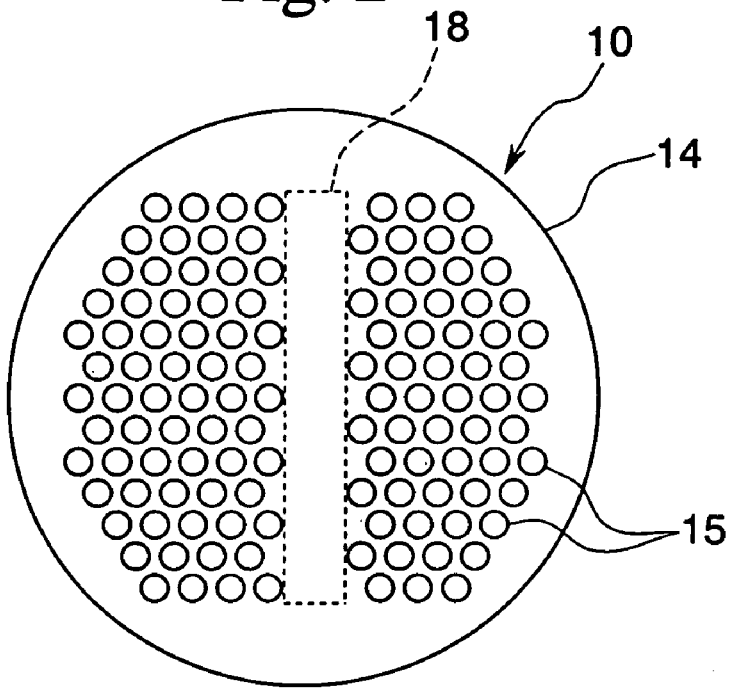
FIG. 2 is a schematic cross-sectional diagram showing the first embodiment of the present invention.

FIG. 2 is a cross-sectional view along the line II—II in FIG. 1. A shown in FIG. 2, the condenser comprises a cylindrical vessel 14 and a plurality of heat exchanger tubes 15 which are arranged as a bundle in the vessel 14.

The heat exchanger tubes are used for the flow of the cooling water and they are arranged along the longitudinal direction (perpendicular direction to the paper in FIG. 2) of the vessel 14. There are two groups of heat exchanger tubes 15, one which is the forward side or first group heat exchange tubes communicated with the cooling water inlet 16 and another is the backward side or second group heat exchanger tubes communicated with cooling water outlet 16, and the direction of the cooling water flow in the forward side tubes 15 differs from that in the backward side tubes 16.

As shown in the cross-sectional view of FIG. 2, a vacant space 18 is provided in the condenser 10 according to the present embodiment. This vacant space 18 passes vertically across the area wherein the heat exchanger tubes are disposed, and this space 18 separates heat exchanger tubes into right and left groups. Note that the above vacant space 18 can be formed by extracting the heat exchanger tubes 15 which were originally disposed in the position of the space 18. Thus, this space is hereinafter called an "extracted row".

The condensation performance of the condenser according to the present embodiment can be improved by preventing the concentration and accumulation of the condensed liquid (liquid refrigerant) on the heat exchanger tubes disposed at the central portion of the vessel by providing the extracted row.

In addition, provision of the extracted row improves the condensation performance of the condenser by promoting the supply of the gaseous refrigerant between the heat exchanger tube groups 15.

Although only one extracted row is formed in the above-described embodiment, two or more extracted rows may be provided by disposing them separated at constant intervals passing through upper and lower side of the vessel (not shown). In such a case, it is preferable to form extracted rows having a width corresponding to one to three lines of heat exchanger tubes 15 for every 10 lines of heat exchanger tubes.

Providing a plurality of extracting rows as above makes it possible to improve the heat transfer performance of the heat exchanger tubes by reducing the accumulation of the condensed refrigerant in the vessel and the heat transfer performance is further improved by accelerating the supply of the gaseous refrigerant.

Figure 3:
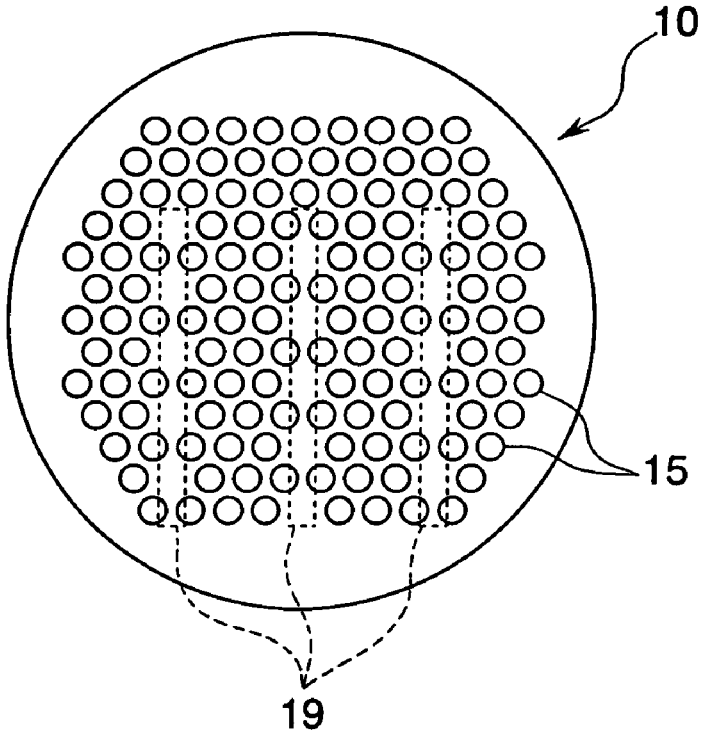
FIG. 3 is a schematic cross-sectional diagram showing the second embodiment of the present invention.

FIG. 3 shows a cross-sectional view of another embodiment of the present invention in which three extracted rows 19 are formed extending from the bottom to the upper portion of the area wherein the heat exchanger tube group 15 is disposed. As shown in FIG. 3, the extracted rows do not reach the top portion of the area wherein the heat exchanger tubes 15, because the condensed refrigerant is not likely to accumulate around the heat exchanger tubes 15 located upwards of the area wherein they are disposed because the condensed refrigerant descends to the lower part of the vessel 14 under the effect of gravity.

Formation of the extracted rows according to the present embodiment improves the efficiency of the condenser more than enough to offset the decrease in the heat exchange efficiency due to the reduction of the number of heat exchange tubes.

On the upper side of the extracted rows 19, it is preferable to leave more than two lines of heat exchanger tubes 15. It is a matter of course that, in this embodiment, each extracted row 19 may be formed by extracting less than three rows or more than three rows of heat exchanger tubes.

Figure 4:
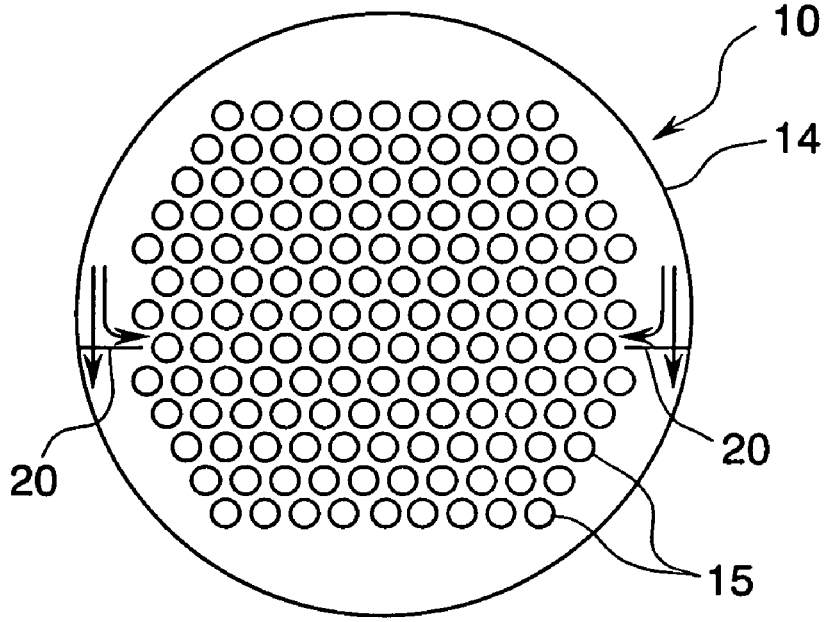
FIG. 4 is a schematic cross-sectional diagram showing the third embodiment of the present invention.

FIG. 4 shows another embodiment of the present invention. The condenser 10 according to this embodiment comprises, in addition to the heat exchanger tubes, two porous plates 20 disposed at both the right and left center portions of the inner surface of the vessel 14 and the porous plates are attached the inner surface of the vessel 14 so as to protrude horizontally along the longitudinal direction (perpendicular to the sheet plane of FIG. 4) of the vessel 14.

According to this embodiment, since a portion of the refrigerant vapor circulating along the inner surface of the vessel 14 is guided and introduced into the center portion of the vessel 14 by the porous plates, and the introduction of the gaseous refrigerant into the center portion of the heat exchange tubes assists the effective liquefaction of the refrigerant and effective discharge of the liquid refrigerant from the vessel, preventing the accumulation of the liquid refrigerant in the vessel. As a result, the accumulation of the condensed liquid refrigerant in the vessel 14 can be reduced, in other words, the thickness of the liquid layer refrigerant formed on the heat exchanger tubes can be reduced, so that the overall heat transfer efficiency of the condenser is increased. It should also be noted that the above-described porous plate can be added to the vessels 14 shown in FIGS. 2 and 3.

Figure 5:
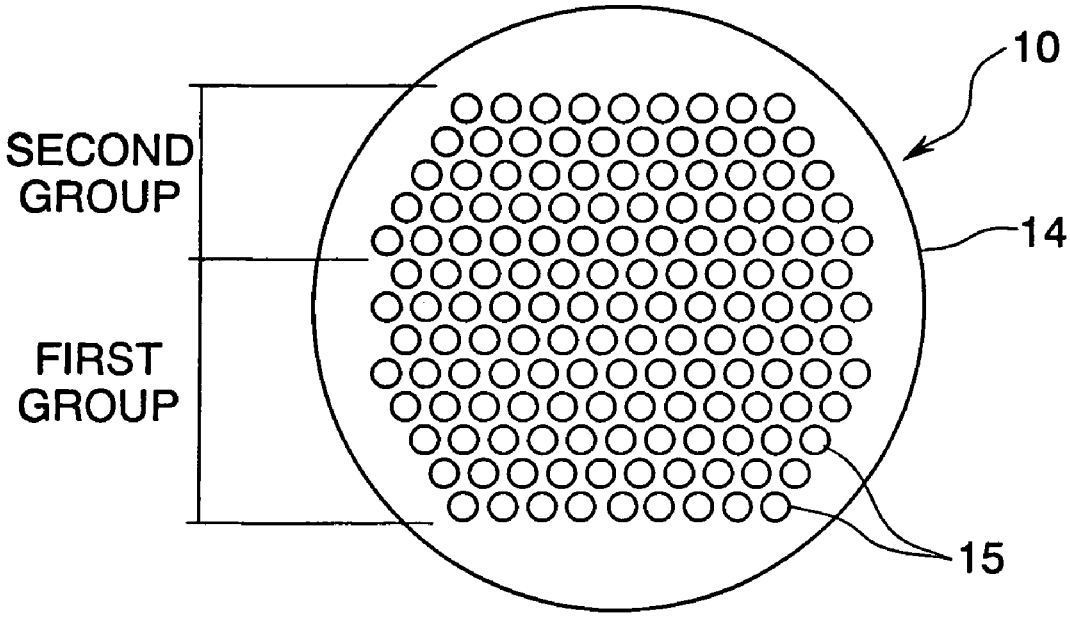
FIG. 5 is a schematic cross-sectional diagram showing the fourth embodiment of the present invention.

FIG. 5 shows another embodiment of the present invention. In the condenser 10 according to this embodiment, the number of the heat exchanger tubes belonging to the first passing group located in the lower part of the vessel 14 which are connected to the cooling water inlet 16, as shown in FIG. 1, is increased, and the number of the heat exchanger tubes belonging to the second passing group tubes, as shown in FIG. 1, located in the upper part of the vessel 14 which are connected to the cooling water outlet 17 is decreased.

That is, all of the heat exchange tubes 15 in this embodiment are disposed at equal pitch and the area for disposing the second group of heat exchange tubes is smaller than the area for disposing the first group of heat exchange tubes. Thereby, the number of second group heat exchange tubes located above is decreased than the number of the first group heat exchange tubes located below.

According to the present embodiment, the amount of the condensed liquid formed in the upper part of the area where the tubes are disposed is reduced, so that the amount of condensed liquid falling on the heat exchanger tubes located in the lower part of the area where the tubes are disposed is also reduced.

Accordingly, the degradation of the heat transfer property of the heat exchange tubes arranged lower of the vessel can be suppressed and the resulting overall heat transfer property of the condenser is improved.

Figure 6:
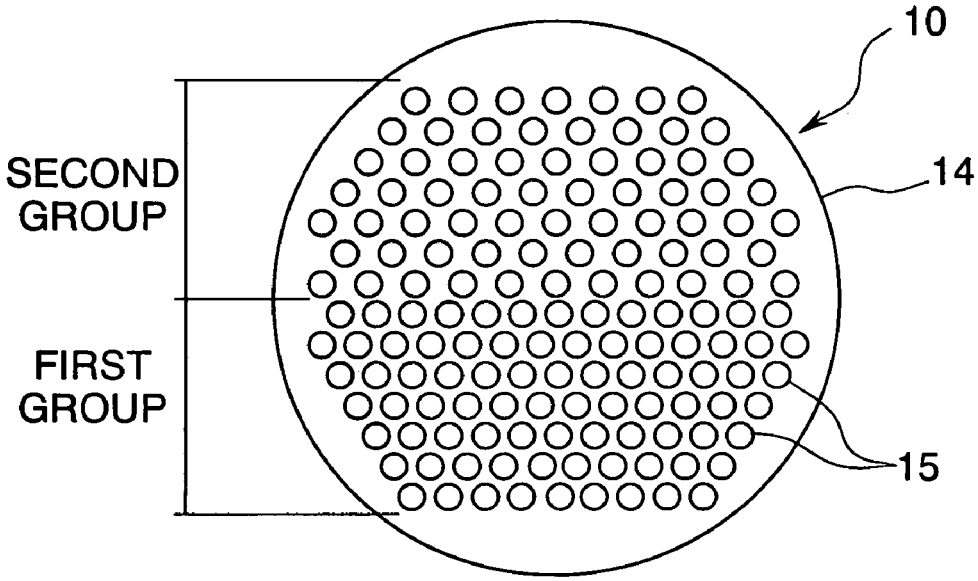
FIG. 6 is a schematic cross-sectional diagram showing the fifth embodiment of the present invention.
Figure 7:
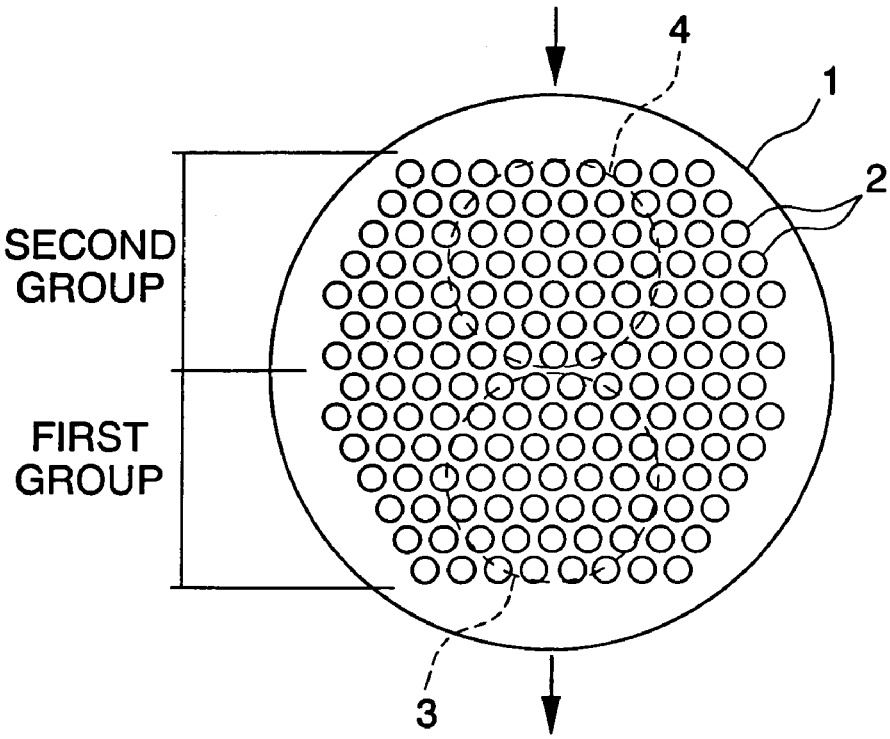
FIG. 7 is a schematic cross-sectional diagram showing a conventional condenser.

FIG. 6 shows another embodiment of the present invention. In the condenser 10 according to this embodiment, the number of the second group heat exchanger tubes located in the upper part of the vessel is reduced increasing the interval between the second group heat exchanger tubes by 1.1 to 3 times.

In the condenser 10 according to this embodiment, since the number of the second group heat exchanger tubes is reduced, the amount of liquid refrigerant which falls on the exchanger tubes in the lower side of the vessel is reduced and a decrease in the heat transfer performance of the heat exchanger tubes can be suppressed, which results in increasing the overall transfer efficiency of the condenser.

Note that although the heat exchanger tubes in the above-described embodiments are disposed in a staggered manner, the present invention can also be applied to the vessel in which the heat exchanger tubes are disposed with a lattice-like cross section.

As described above, according to one condenser for refrigerating machines of the present invention, since one or a plurality of spaces are formed in the area where the heat exchanger tubes are disposed, the liquid refrigerant can be prevented from accumulating in the above-mentioned spaces, which results in improving the condensation performance of the condenser.

According to another condenser for the refrigerating machine of the present invention, two porous plates are mounted on the inner surface of the condenser vessel for guiding the gaseous refrigerant flowing along the inner surface of the vessel to the central portion of the group of heat exchanger tubes. Guiding the gaseous refrigerant to the central portion of the group of heat exchanger tubes accelerates liquefaction of the gaseous refrigerant and the discharge of the liquefied refrigerant from the vessel, which results in improving the heat transfer efficiency of the condenser by eliminating the accumulation of the liquefied refrigerant in the interstices of the heat exchanger tubes.

According to still another condenser for the refrigerating machine of the present invention, the number of the backward side heat exchanger tubes located in the upper part of the vessel is made smaller than the number of forward side heat exchanger located in the lower part of the vessel. Accordingly, the amount of condensed liquid refrigerant formed by the second group of tubes is reduced, which reduces the amount of the liquid refrigerant which falls onto the forward side heat exchanger tubes, where the heat exchange rate is higher than the backward side tubes due to the larger temperature difference between the refrigerant gas and the cooling water, which results in improving the heat transfer efficiency of the overall heat exchange tubes.

Furthermore, according to still another condenser for the refrigerating machine of the present invention, the pitch of the backward side heat exchange tubes located in the upper part of the vessel is made larger than that of the forward side heat exchange tubes located in the lower part of the vessel. Accordingly, the heat transfer efficiency can be improved by reducing formation of the liquid refrigerant in the upper part of the vessel of the liquid refrigerant, which falls onto the heat exchange tubes in the lower part of the vessel.

What is claimed is:

1. A condenser for a refrigerating machine comprising:

a vessel into which a gaseous refrigerant is introduced; and a group of heat exchanger tubes disposed in said vessel for condensing and liquefying a gaseous refrigerant by heat exchange between said gaseous refrigerant and cooling water circulating in said heat exchanger tubes;

wherein said heat exchanger tubes are disposed at an equal interval, and a group of heat exchanger tubes located in a lower region are used for supplying said cooling water forward and another group of said heat exchanger tubes located in an upper region is used for returning said cooling water backward, and the number of heat exchanger tubes located in said upper region is made smaller than the number of heat exchanger tubes located in said lower region by making the area of said upper region smaller than the area of said lower region.

* * * * *